US005251188A

United States Patent [19]

Parsons et al.

[11] Patent Number: 5,251,188

[45] Date of Patent: Oct. 5, 1993

[54] ELONGATED-PATTERN SONIC TRANSDUCER

[75] Inventors: Natan E. Parsons, Brookline; Joel S. Novak, Sudbury, both of Mass.

[73] Assignee: Recurrent Solutions Limited Partnership, Cambridge, Mass.

[21] Appl. No.: 867,944

[22] Filed: Apr. 13, 1992

[51] Int. Cl.[5] ..... G10K 13/00; H04R 7/00

[52] U.S. Cl. ..... 367/140; 181/157; 181/168; 181/171; 181/173; 381/90; 381/162; 381/193; 381/205

[58] Field of Search ..... 181/123, 139, 157, 168, 181/171, 173; 367/140; 381/90, 162, 193, 202, 205

[56] References Cited

U.S. PATENT DOCUMENTS 3,026,958 3/1962 Haerther, Jr. ..... 181/32

3,935,400 1/1976 Koga ..... 181/173 X 4,319,098 3/1982 Baitchor ..... 181/166 X 4,327,257 7/1984 Takayama et al. ..... 367/140 X 4,518,443 5/1985 Yokozeki et al. ..... 181/157 X

*Primary Examiner*—J. Woodrow Eldred

*Attorney, Agent, or Firm*—Cesari and McKenna

[57] ABSTRACT

A sonic transducer (10) includes an elongated diaphragm (12) secured to a base (14) by a clamping member (16). The shapes of the surfaces (26, 30) by which the base (14) and clamping element (16) engage the diaphragm (12) are different at the end regions (28) from what they are in the side regions (32). The result is a more-rigid clamping at the ends than at the sides, which causes the lengthwise and widthwise stiffnesses of the diaphragm to be more nearly equal and thus the sound production from various regions of the diaphragm to be more nearly in phase than they would be if the clamping were uniform.

10 Claims, 3 Drawing Sheets

ELONGATED-PATTERN SONIC TRANSDUCER

The present invention is directed to sonic transducers. It finds particular, although not exclusive, application to transducers employed resonantly.

There are a number of applications, such as proximity detectors for automobiles, in which it is desirable to have the pattern of a sonic (typically, ultrasonic) transducer that is elongated; in the case of a car, it is desirable for the pattern's horizontal extent to be greater than its vertical extent. As a practical matter, most proposals for this purpose have resulted in employing a plurality of transducers arrayed along, say, the car's bumper. That is, each transducer would be large enough to have a relatively narrow pattern, and thereby not "pick up" the road, but the elongated array of transducers would collectively result in a pattern that is wide in the horizontal direction.

Clearly, the number of transducers required would be lower if each transducer itself produced an elongated pattern. This has not heretofore been the preferred approach, however, because the necessarily oblong transducers tend to generate irregular beam patterns; the transducers for such purposes ordinarily are operated near resonance, and the oblong shapes tend to result in non-uniform phasing in the resultant sound waves.

SUMMARY OF THE INVENTION

I have found that it is possible to achieve beam uniformity in a resonantly driven elongated transducer if the transducer is mounted in accordance with my invention. If the transducer is of the type that comprises an elongated diaphragm mounted on a base, the end edges, i.e., the edges at the ends of the lengthwise dimension, should be secured to the base more rigidly than are the side edges, i.e., the edges at the ends of the widthwise dimension.

The difference in rigidity can be achieved in a number of ways. One is to employ more of a simple support at the side edges and more of a clamp support at the end edges. Another is to employ more or less compliant materials for the different clamping members or the cementing material by which the transducer elements are held together. In either event, the difference in the rigidity of the securing members should be such as to result in lengthwise stiffness that is near to the widthwise stiffness. The result will be that motion in the two modes will be more nearly in phase at frequencies near resonance.

BRIEF DESCRIPTION OF THE DRAWINGS

These and further features and advantages of the present invention are described below in connection with the accompanying drawings, in which.

DETAILED DESCRIPTION OF ILLUSTRATIVE EMBODIMENTS

Figure 1:
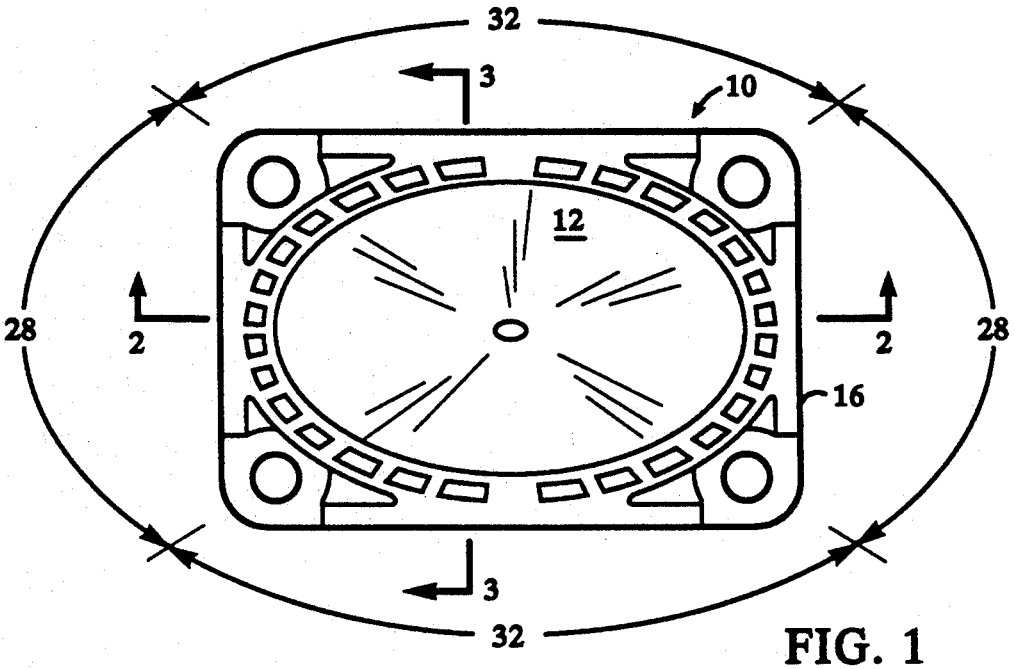
FIG. 1 is a plan view of an ultrasonic transducer that employs the teachings of the present invention.
Figure 2:
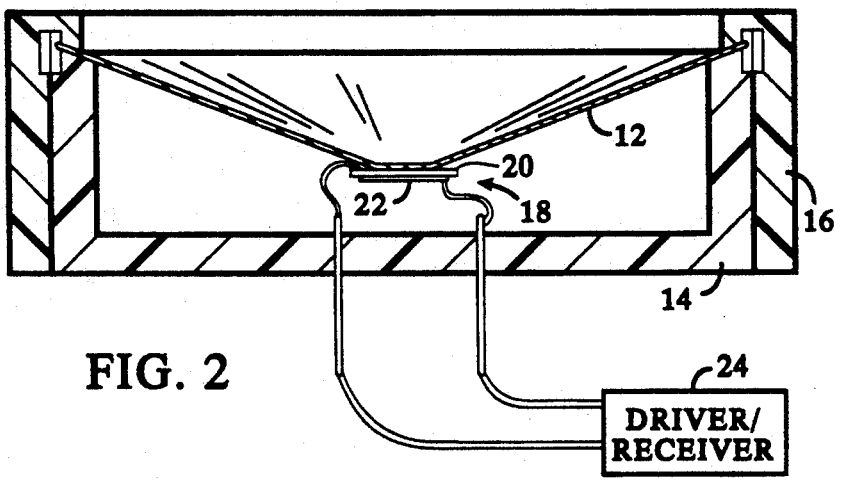
FIG. 2 is a cross-sectional view of the transducer of FIG. 1 taken at line 2—2 of FIG. 1.
Figure 3:
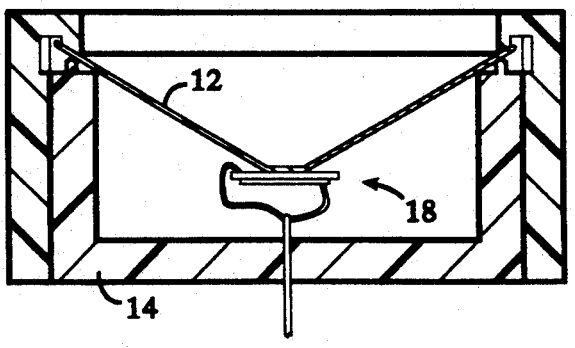
FIG. 3 is a cross-sectional view of the transducer taken at line 3—3 of FIG. 1.

FIGS. 1, 2, and 3 depict a transducer 10 employed, in this case, for both transmission and reception of ultrasound. It will be clear that the teachings of the present invention can be employed in other types of sonic transducers, too, including those for transmitting and/or receiving sound in the audible range. The transducer 10 includes a cone-shaped diaphragm 12 made of an alloy of aluminum and beryllium. It is mounted on a base 14 to which it is secured by a (in this case, unitary) clamping element 16.

The diaphragm 12 is driven by a piezoelectrically based driver element 18, which in this case includes a metallic disk 20 and a piezoelectric disk 22, which expands and contracts radially in response to voltage applied thereto and thereby causes buckling of the metal disk and vibration of the diaphragm 12. A driver/receiver circuit 24 applies the necessary driving signals across element 18 to cause it to transmit ultrasound. Driver/receiver circuit generates the electrical signals at a frequency near a resonant frequency of the diaphragm 12. For use as a proximity sensor, it then awaits electrical signals that the transducer 10 generates in response to received echoes.

Figure 4:
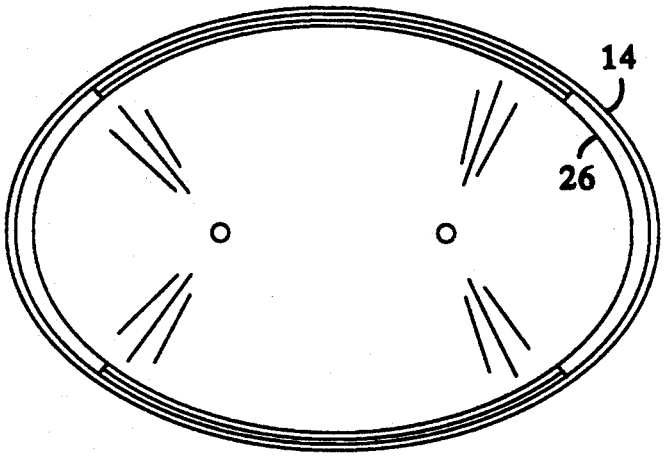
FIG. 4 is a plan view of the base employed in the transducer of FIG. 1.

As FIG. 4 shows, the base 14 provides an inner, oval lip 26 upon which the periphery of the diaphragm 12 rests. In accordance with the present invention, the clamp 16 secures the periphery to the lip 16 in a particularly advantageous way, as will now be explained in connection with FIGS. 5 and 6.

Figure 5:
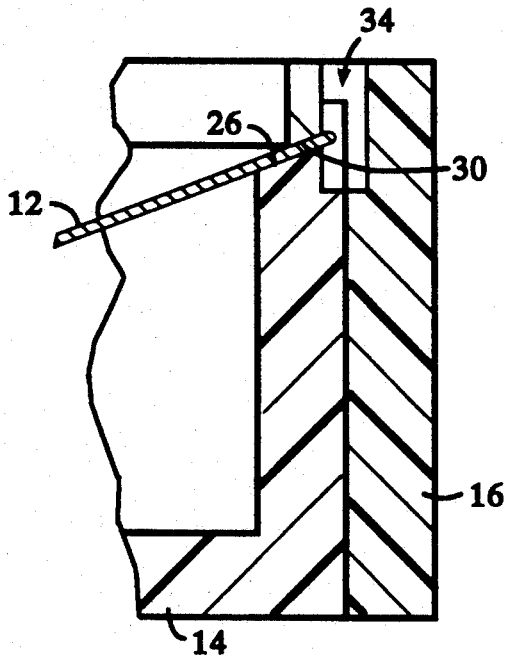
FIG. 5 is a detailed view of the clamping junction depicted in FIG. 2.

FIG. 5 is a detail of the interfaces among the clamp, diaphragm, and base in the end region 28 of FIG. 1. As that drawing shows, the lip 26 of the base 14 forms a generally beveled shape that more or less conforms to the lower surface of the diaphragm periphery. A complementary surface 30 is formed on the clamping member 16 so as to form a relatively rigid clamping junction. In addition to preventing any substantial translational motion of the cone 12 with respect to the base 14, that is, it is also relatively resistant to rotational motion about any axis perpendicular to the paper in the clamping region.

Figure 6:
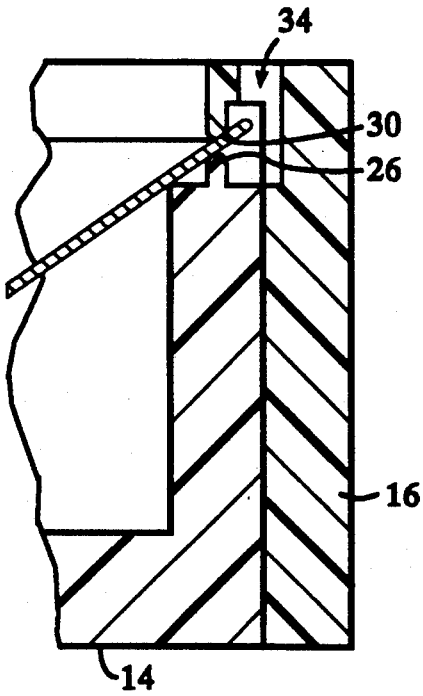
FIG. 6 is a detailed sectional view of the clamping junction depicted in FIG. 3.
Figure 7:
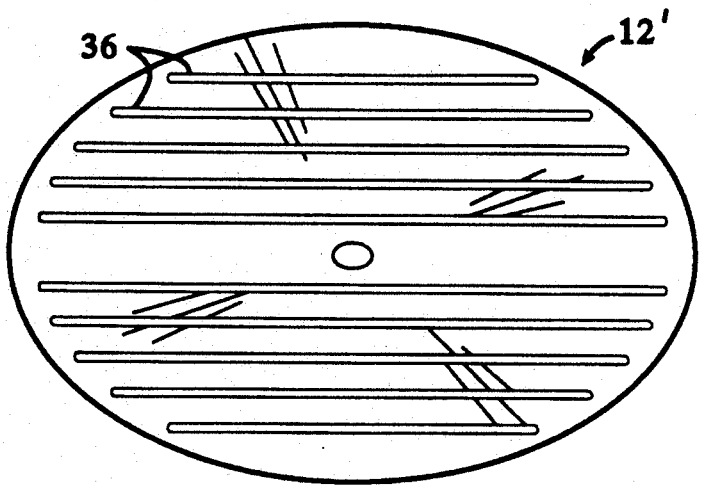
FIG. 7 is a plan view of an alternative diaphragm for use in a transducer employing the teachings of the present invention.
Figure 8:
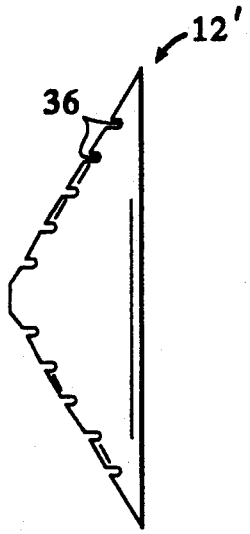
FIG. 8 is a cross-sectional view taken at line 8—8 of FIG. 7.

In contrast, lip 26 has a more-pointed profile in regions 32 of FIG. 1, as FIG. 6 illustrates. A more-pointed profile is also exhibited by the complementary surface 30 on the clamping member 16. As a consequence, although these surfaces still clamp the diaphragm 12 in region 32, the clamping is not as rigid; although it is nearly as effective in preventing translational motion of the diaphragm 12, it offers little resistance to rotation about an axis extending into the paper between complementary surfaces 26 and 30. Another way of saying this is that the diaphragm is secured in region 32 by something approximating a simple support, while a clamping support secures it to the base 14 in region 28.

The result of the difference in the rigidity with which the diaphragm is secured in the different regions is that the stiffnesses of the diaphragm in the different directions are more nearly equal. That is, if a lengthwise strip were cut through the diaphragm 12, the resistance of that strip to deflection would be more nearly equal to the resistance to deflection of a similarly cut widthwise strip than it would be if clamping in the two regions were the same.

Further contributing to the difference in clamping rigidity is the manner in which the diaphragm, base, and clamping element are cemented together. As FIGS. 1, 5, and 6 show, the clamping element 16 forms a plurality of fill holes 34 that are provided to admit cementing material into a void 36, formed by the base 14 and the clamping element 16, into which the diaphragm 12 extends. After the parts have been assembled in the manner depicted in FIGS. 1-6, appropriate cementing material is introduced through these holes. But the material used in the end regions 28 for this purpose is relatively rigid, being, say, fiber-impregnated thermosetting epoxy. In contrast, the cementing material used in region 32 is more compliant, such as RTV or other synthetic elastomer. That is, in the illustrated embodiment, the difference in rigidity is accomplished both by the shapes of the surfaces that engage the diaphragm and by the rigidity of the cementing material. Clearly, of course, either approach can be used individually, too, as can any other way of achieving a difference between the rigidities with which the end and side regions are secured.

The invention can be employed in a wide range of diaphragm shapes. However, I believe that it will be found most worthwhile in diaphragms whose lengths are at least 1.2 times their widths. Moreover, there are many combinations of approach that can be employed to achieve the rigidity difference, and the precise combination may need to be determined empirically in many cases. Whatever approach is employed, however, I believe that it is desirable, in resonantly operated transducers, for the resultant lengthwise stiffness of the diaphragm is within fifty percent of its widthwise stiffness.

Another beneficial aspect of the invention is the makeup of the diaphragm 12 itself. As was mentioned above, it comprises an alloy of beryllium and aluminum. I have found that this material reduces the density of resonant modes for a given weight. This contributes to the efficiency of the transducer. Indeed, for the illustrated shape, we have observed an efficiency, in terms of sound power level out at a given position versus electrical power, at least 20% greater than that of any comparable sonic transducer of which we are aware.

In the illustrated embodiment, I employ an alloy of 60% beryllium and 40% aluminum, but the particular alloy employed for a particular application will be determined by a number of practical factors, including the formability of the particular alloy and the desired shape. Preferably, however, the alloy should contain between 40% and 90% beryllium, between 10% and 60% aluminum, and less than 5% other elements.

In addition to the material of which the diaphragm is made, another stiffness-contributing factor is its shape. The embodiment illustrated in FIGS. 1-6 employs a cone-shaped diaphragm, and, although such a shape is not absolutely required in order to employ the broader teachings of the present invention, it is highly preferable, because of the greater stiffness that it provides as compared with a simple disk shape.

To add even further stiffness, moreover, one might employ one of the alternate embodiments depicted in FIGS. 7-10.

FIGS. 7-10 depict an alternate diaphragm 12' that includes longitudinal ribs 36 formed in its surface. Although the cone shape itself provides considerable stiffness, the ribs further increase stiffness without detracting detectably from the desired sound-power pattern.

Figure 9:
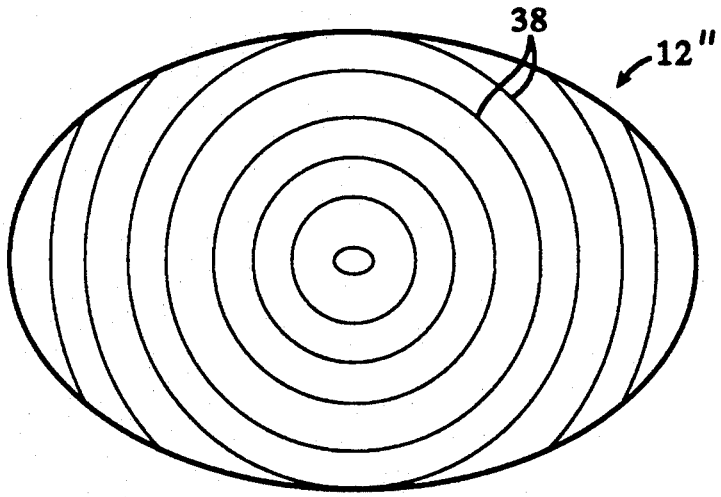
FIG. 9 is a plan view of yet another alternative diaphragm.
Figure 10:
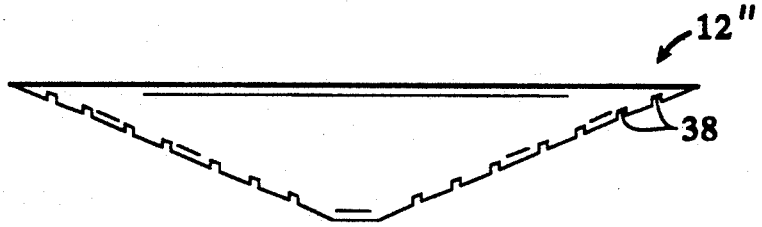
FIG. 10 is a sectional view of the FIG. 9 diaphragm taken at line 10—10 thereof.

Alternately, the ribs can be made circumferential, as they are shown in FIGS. 9 and 10, which depict yet another alternate diaphragm 12'' that has circumferential ribs 38. In both cases, the drawings show the ridges as being provided by indentations in the diaphragm's bottom surface. Clearly, however, the same result could be achieved by the reverse shape, i.e., by rearly extending bosses; it could also be achieved by a combination of the two types of ribs.

A review of the foregoing description will make it clear that the present invention enables significant a reduction to be made in the number of transducers required for certain applications in which an elongated sonic pattern is desired. Additionally, it provides significant efficiency advantages and can be employed in a wide range of embodiments. Accordingly, the present invention constitutes a significant advance in the art.

What is claimed is:

1. A sonic transducer comprising:

A) a base;

B) a diaphragm forming end edges and side edges and having a width between its side edges and a length between its end edges that is at least 1.2 times the width;

C) means for converting between diaphragm motion and electrical signals; and

D) means for securing the diaphragm's side edges to the base, thereby causing the diaphragm to have a lengthwise stiffness, and for securing its end edges to the base sufficiently more rigidly than the side edges that the diaphragm has a lengthwise stiffness within 50% of its widthwise stiffness.

2. A sonic transducer as defined in claim 1 wherein the means for securing the diaphragm's edges to the base comprise means for securing the end edges with more nearly a clamping support and the side edges with more nearly a simple support.

3. A sonic transducer as defined in claim 2 wherein the means for securing the diaphragm's edges to the base include a relatively rigid cement that secures the diaphragm's end edges to the base and a different, more-compliant cement that secures the diaphragm's side edges to the base.

4. A sonic transducer as defined in claim 1 wherein the means for securing the diaphragm's edges to the base include a relatively rigid cement that secures the diaphragm's end edges to the base and a different, more compliant cement that secures the diaphragm's side edges to the base.

5. A sonic transducer as defined in claim 1 wherein the means for converting between diaphragm motion and electrical signals includes a piezoelectric driver.

6. A sonic transducer as defined in claim 1 further including a driver circuit for applying, to the means for converting between diaphragm motion and electrical signals, electrical signals of approximately a resonant frequency of the diaphragm.

7. A sonic transducer as defined in claim 1 wherein the diaphragm has a generally ovally conical shape.

8. A diaphragm as defined in claim 7 wherein the diaphragm surface forms ribs.

9. A sonic transducer as defined in claim 8 wherein the ribs extend generally longitudinally of the diaphragm.

10. A sonic transducer as defined in claim 8 wherein the ribs extend generally circumferentially about the diaphragm.

* * * * *